United States Patent [19]

Beck

[11] 4,258,237

[45] Mar. 24, 1981

[54] SWITCH ASSEMBLY

[76] Inventor: Wesley H. Beck, 307 Church St., Clayton, N.C. 27520

[21] Appl. No.: 948,565

[22] Filed: Oct. 4, 1978

[51] Int. Cl.[3] ..... H01H 15/00; H01H 19/54; H01H 21/76

[52] U.S. Cl. ..... 200/11 J; 200/16 C

[58] Field of Search ..... 200/16 C, 16 D, 16 F, 200/11 A, 11 G, 11 J, 11 K, 8 A, 153 K, 291, 290, 303, 277

[56] References Cited

U.S. PATENT DOCUMENTS

| | | | |
|---|---|---|---|
| 1,873,527 | 8/1932 | Anfinnsen et al. | 200/11 J |
| 2,418,616 | 4/1947 | Batcheller | 200/6 R |
| 2,753,432 | 7/1956 | Long et al. | 200/277 X |
| 2,765,376 | 10/1956 | Palmer | 200/8 A |
| 3,856,999 | 12/1974 | Terry et al. | 200/11 K |
| 3,882,056 | 5/1975 | Nakasone | 200/16 C |
| 4,022,994 | 5/1977 | Raab et al. | 200/291 X |
| 4,031,345 | 6/1977 | Garcia | 200/16 C X |
| 4,132,874 | 1/1979 | Bruni et al. | 200/16 F |

*Primary Examiner*—James R. Scott
*Attorney, Agent, or Firm*—Mills & Coats

[57] ABSTRACT

This invention is an improved electrical switch in which the housing is molded in one piece with the terminals being thereafter slidably inserted into an arcuate in cross section slot with a cover plate permanently retaining the same. This switch is so designed that even miniature configurations are capable of handling current loads without danger of internal arcing.

12 Claims, 10 Drawing Figures

SWITCH ASSEMBLY

FIELD OF INVENTION

This invention relates to electrical devices and more particularly to electrical switching means.

BACKGROUND OF INVENTION

Since man first began to use electricity as a power source, he has been faced with the problem of not only turning the current on and off but also switching of such current between circuits. Various types and configurations of switching means have been developed over the years and even automatic switching under predetermined conditions has been accomplished.

In recent years with the advent of miniaturized electronic components, the need for smaller while at the same time less expensive switching means has become increasingly necessary. In the miniaturizing of electrical and electronic circuits, the cost has been decreased tremendously because of simplification of the equipment involved. Switches on the other hand have become difficult to produce in miniaturized form because of the intricacy of the die tools required as well as greater cost in either the skilled labor needed or in complex automated machine required.

SUMMARY OF INVENTION

After much research and study into the above-mentioned problems, the present invention has been developed to provide an improved miniature type switching means which can be installed on and used in conjunction with printed circuits, can be quickly and efficiently assembled, has an extremely high operational current rating, and is rugged in construction.

In view of the above, it is an object of the present invention to provide a simply constructed and yet rugged miniature type switch of superior current carrying capacity.

Another object of the present invention is to provide an improved electrical type switch wherein the terminals are slidingly inserted and are captured or retained by a cover plate means.

Another object of the present invention is to provide an improved switch means wherein a slide guide is provided for smoother operation and to reduce the chance of current arcing between terminals.

Another object of the present invention is to provide a switch means wherein the terminals themselves act as detent retainers.

Another object of the present invention is to provide a multi-position switch which can be spring loaded in either longitudinal direction or for center return without changing the basic mold form.

Another object of the present invention is to provide, in a slide type switch, a molded configuration which is adaptable to load in either longitudinal direction or center loading without structural changes being required to such switch.

Another object of the present invention is to provide a switch means wherein the openings for the terminals are slightly smaller than the terminals inserted therein whereby a housing to terminal seal is effectuated.

Another object of the present invention is to provide an improved switch means of the rotary type wherein the switch cap acts as a terminal capturing and retaining means.

Another object of the present invention is to provide, in a rotary type switch, a disc shaped contact which uses the terminals themselves for both making the circuit and acting as a detent.

Another object of the present invention is to provide an improved miniature switch means having a flash guard incorporated thereinto to prevent internal damage during ultrasonic welding of the cover plate to the switch housing.

Another object of the present invention is to provide an improved switch means wherein the side walls of the housing are ultrasonically bent over the housing enclosure to form a rugged unitary switch case.

Another object of the present invention is to provide a switch housing case wherein the seams of the same are ultrasonically welded from an integrally formed weld bead.

Another object of the present invention is to provide, in a miniature type switch suitable for use in connection with printed circuits, bearing projections extending outwardly from the switch housing to steady the mounting between said switch and said board.

Other objects and advantages of the present invention will become apparent and obvious from a study of the following description and the accompanying drawings which are merely illustrative of such invention.

DETAILED DESCRIPTION OF INVENTION

Figure 1:
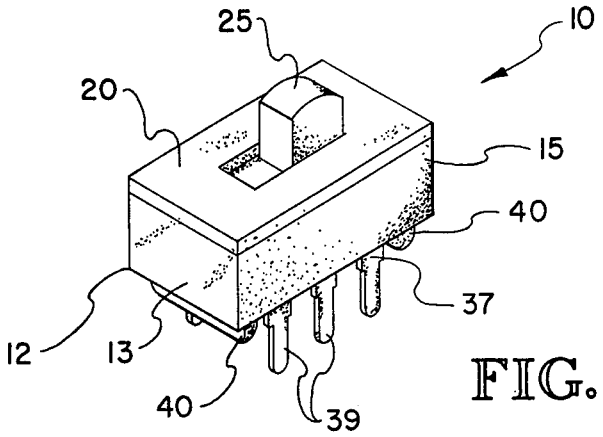
FIG. 1 is a perspective view of the miniature slide switch version of the present invention.

With further reference to the drawings, the slide version of the switch of the present invention is indicated generally at 10 and the rotary version of the same is indicated generally at 11.

Although the following description will refer to the embodiments of the present invention as having a top, bottom, sides, ends, and the like as well as upwardly and downwardly projecting portions, it is to be understood that these terms are used only to describe the parts as oriented in the drawings since obviously the swtich means of the present invention can be oriented in many different positions when in actual use.

Referring first specifically to the slide switch version 10 disclosed in FIGS. 1 through 5, an open top, box-like housing 12 is formed from plastic or other suitable material and includes end walls 13, side walls 15 and a bottom 17.

Figure 4:
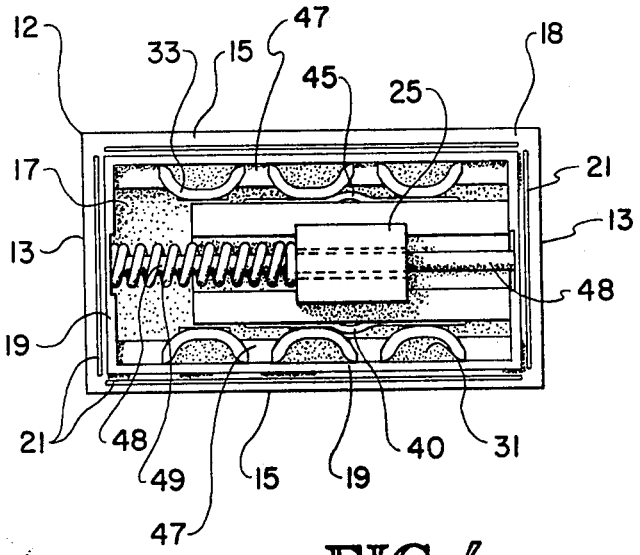
FIG. 4 is a top plan view of the assembled, spring loaded switch prior to the fore cover being fused on the housing.

About the upper periphery 18 of housing 12 is an upwardly projecting flash guard 19. A weld bead 21 is also formed on the upper periphery 18 as seen in FIG. 4. When the cover plate 20 is ultrasonically vibrated relative to housing 12 as will hereinafter be described in greater detail, weld bead 21 melts to fuse or weld such face plate to said housing. As this is accomplished, the flash guard 19 prevents the melted bead from inadvertently entering the interior of switch 10 since should this happen internal damage to the switch could occur.

Figure 5:
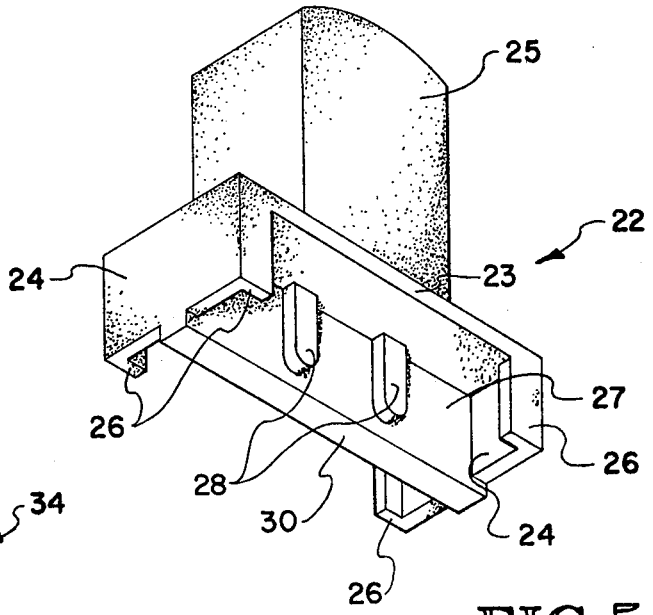
FIG. 5 is an enlarged bottom perspective view of the slide portion of the slide switch version of the present invention.

The slide 22 of this version of the present invention, shown particularly clear in FIG. 5, includes a generally flat base portion 23 having end portions 24 formed on one side and on outwardly projecting actuator 25 formed on the other side thereof. At the outer edges of each of the end portions 24 are formed inwardly projecting flange portions 26. The purpose of these flanges will become more apparent from the following description.

Extending between end portions 24 and base portion 23 is a guide rail pattern partition 27. On each side of the rail partition 27 is formed spring retainer ribs 28.

A slot 29 is formed in the interior of bottom 17 of housing 12 and is adapted to slidingly receive the bottom portion 30 of rail partition 27 which projects below the end portions 24 as can clearly be seen in FIG. 3.

Formed in the interior side walls 15 are a plurality of terminal receiving rails or openings 31. Each of these rail openings or slots includes an inwardly beveled portion indicated at 32. From the drawings, particularly FIG. 2, it can be seen that the inwardly projecting beveled portions 32 restrict openings 41 to readily slidingly receive the flange portion 33 of the terminal indicated generally at 34.

Figure 3:
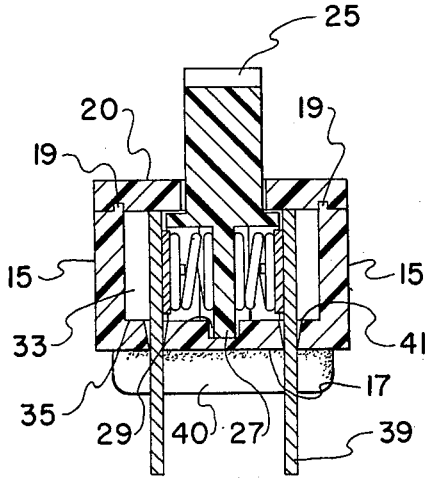
FIG. 3 is a sectional view taken through lines 3—3 of FIG. 2.

The longitudinal length of flange portion 35 is equal to the interior height of the side walls 15 thus the bottom portion 35 of such flange is adapted to rest juxtaposed to the interior of housing bottom 17 and the upper edge 36 is adapted to lie juxtaposed to cover plate 20 as seen clearly in FIG. 3.

The intermediate portion 37 of terminal 34 includes mounting board engaging shoulders 38. If a printed circuit type board is being used in conjunction with the switch of the present invention, the shoulders, of course, would be disposed adjacent the upper surfaces of such board with the prong portion 39 of terminal 34 projecting therethrough and adapted to be connected to the circuits in conjunction with which the switch is being used.

On the exterior of each end of the bottom 17 of housing 12 is formed a mounting support 40. These supports, like shoulders 28, are adapted to engage the mounting board (not shown) on which the switch is used. The advantage of these supports in stablizing the switch in its final use position are obvious.

In parallel alignment with each of the rail openings 31 is a bottom terminal opening 41. As can be seen in FIG. 3, each of these openings is tapered to aid in the insertion of the terminals 34 therein. The size of each of the openings 41 is preferably at its smallest or narrowest point at least a thousandth of an inch smaller than the intermediate portion 37 of terminal 34 which is adapted to pass therethrough. By being tapered, easy insertion of the terminal through the opening can be accomplished and yet being slightly smaller than the terminal, a tight binding fit will be accomplished which will first tend to hold the terminal in place and secondly will seal the opening where the terminal passes through the housing thus preventing foreign matter from entering the switch through this location.

To assemble the switch of the present invention as hereinabove described, the housing shell 12 has each of the terminals 34 slid into their respective rail openings 31 with the flange portions 33 retainingly engaging the inwardly beveled portions 32. The prong and intermediate portions 39 and 37 of terminal 34 are passed through terminal opening 41 until the bottom edge 35 of flange 33 engages the interior of the housing bottom 17.

Next the slide 22 is assembled with the off set flange portion 43 at each end of the metallic terminal strip 42 being inserted under the flange portions 26 of slide end portions 24. The off set flange portions 43 are, of course, captured by the slide flanges 26 as can clearly be seen in FIG. 2.

Figure 2:
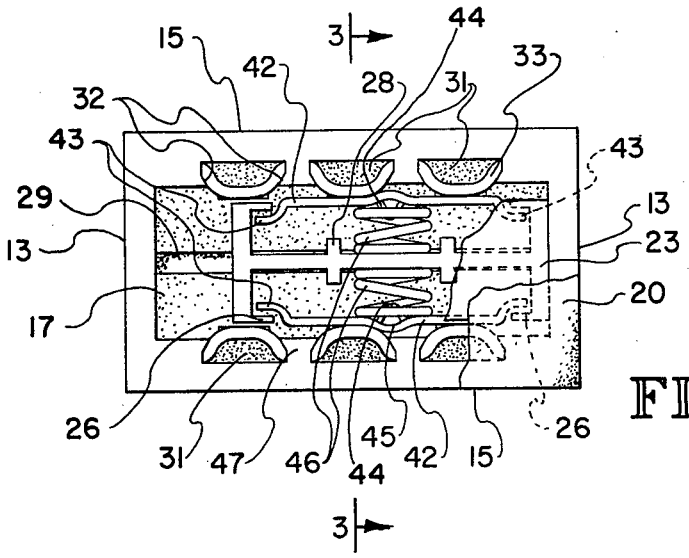
FIG. 2 is a partial top cutaway view of the switch shown in FIG. 1.

Each of the terminal strips 24 includes a crimped, inwardly projecting portion 44 and an outwardly projecting detent portion 45, again as clearly seen in FIG. 2.

Terminal strip springs 46 are inserted between the retaining ribs 28 of partition 27 and are retained at one end thereby while the other end of such springs engage projection 44 thus assuring proper orientation of springs 46 during use of the switch of the present invention.

The thus assembled slide 22 is placed into housing 12 (with its already installed terminals 34). The cover plate 20 is then put in place and ultrasonic vibrations set up which by friction causes the welding beads 21 on periphery 18 of housing 12 to melt thus permanently welding the cover to the housing. When in this assembled position, the flange portion 33 of each of the terminals 34 is held in fixed position between the cover 20 and the bottom 17.

Since guide partition 27 is mounted in and longitudinally slides along slot 29, a flash or arcing barrier is provided between opposed terminals 34. Also the side wall area 47 between the rail openings 31 serves as an insulating barrier between adjacent terminals. Between the insulating side wall area 47 and the centrally disposed guide partition 27, an extremely high amperage rated switch is created.

Whenever actuator 27 is moved longitudinally relative to switch 10, the springs 46 will outwardly bias the terminal strips 42 juxtaposed to the flange portions 33 of terminals 34. When the actuator 25 moves the slide 22, the detent 45 will, of course, compress springs 46 so that such detent can slide passed its adjacent terminal.

In the configuration shown, the circuit between adjacent terminals can be opened and closed by movement of the actuator 25. It is understood, however, that other combinations can be included by slight internal modification of the slide 22 and its associated terminal strips 42 without departing from the spirit of the present invention.

On occasion it is desired to have the slide 22 automatically return to a predetermined location once the actuator 25 has been manipulated and released. In this case, a rod 48 is provided which is passed through the actuator 25 just above base portion 23. This rod extends longitudinally the interior length of housing 12 and a biasing spring 49 is provided as shown in FIG. 4. This spring encircles rod 48 with one end against end portion 13 and the other end against actuator 25. As the actuator is pushed to the left in FIG. 4, it will compress spring 49 but when released, the actuator and its associated slide 22 will return to the normal position shown. If, of course, a greater plurality of terminals 34 are used, it may be desirable to have the switch spring loaded in both directions with a central return being normal. In this case, a second biasing spring 49 would simply be added to the other side of the actuator 25 so that regardless of which direction such actuator was moved, it would always (through the opposing biasing of the springs) return to the central location when released.

Referring now specifically to the rotary version 11 of the switch of the present invention, a generally circular housing 50 is provided which includes a circular side wall 51 and a bottom 52.

Figure 9:
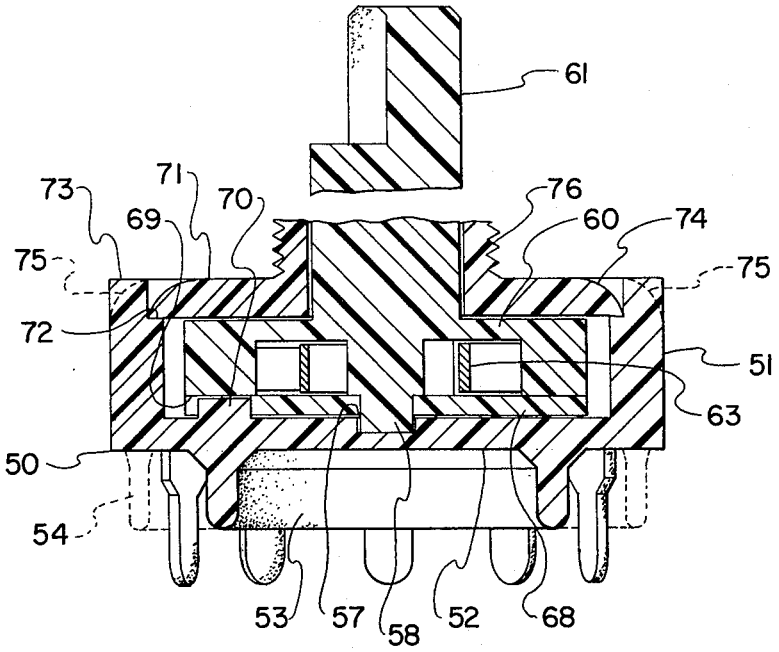
FIG. 9 is a sectional view taken through lines 8—8 of FIG. 7.

A generally circular mounting support 53 is provided which serves the same purpose as mounting support 40 on the slide switch version 10 of the present invention. If so desired, a second generally circular mounting support such as that shown in dotted lines at 54 in FIG. 9 can be provided. This modification gives protection for the terminals 34 since they are disposed interiorly of such support. It would, of course, be a matter of choice whether the inner mounting support 53 would also be used or would be eliminated if the exterior support 54 is used.

Figure 6:
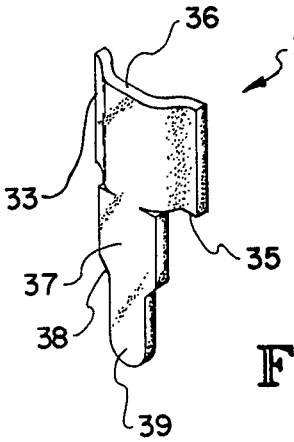
FIG. 6 is a perspective view of the terminal used in connection with the switch of the present invention.
Figure 7:
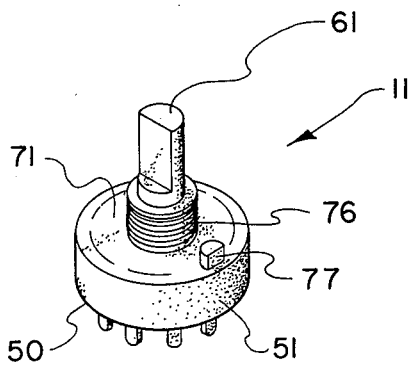
FIG. 7 is a perspective view of the rotary switch version of the present invention.

Terminal retaining slots 31 are provided in the rotary version as can clearly be seen in FIG. 6. The insulating side wall areas 55 between openings 31 are similar to the areas 47 of switch 10. Since the insulating areas 55 have edges 56 which are parallel to the radius of the circular housing 50, these edges function retainingly in the same manner as the inwardly beveled portions 32 hereinafter described relative to the slide switch. Thus the same terminals 34 used in the slide switch can also be used in the rotary swtich and are retained in openings 31 in the same manner in each version of the present invention.

Centrally disposed in the interior of bottom 52 is a circular opening 57 which is adapted to receive pivot shaft 58 as will hereinafter be described in greater detail.

The switch rotor, indicated generally at 59, includes a circular base portion 60 which has an actuator shaft 61 centrally formed on one side thereof.

The other side of base plate 60 from shaft 61 includes two recessed areas. Each of these areas includes an elongated portion 62 adapted to receive a leaf spring 63 and a curved wall portion 64 adapted to captivatingly retain a metallic contact disc 65 as can clearly be seen in FIG. 6.

An outwardly projecting stud 66 is formed on the lower portion of base 60 and is adapted to engage opening 67 in disc retainer plate 68. This retainer plate is partially cutaway to form a slot-like opening 69. An upwardly projecting stop 70 is formed in the bottom 52 of housing 50 and is adapted to engage opening 69. Obviously the greater the peripheral length of opening 69, the greater the distance rotor 59 can be turned within housing 50. Thus by simply changing the configuration of plate 68, the operation of the switch can be modified.

Figure 10:
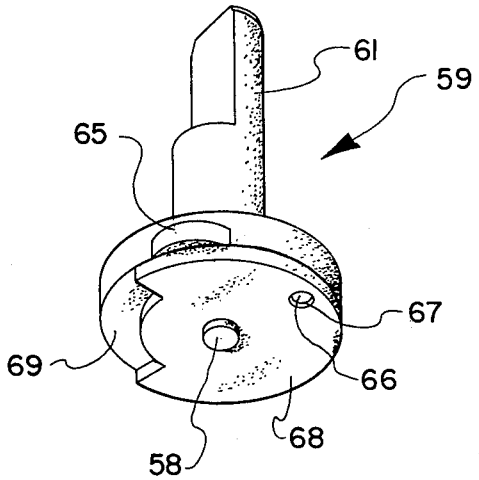
FIG. 10 is a bottom perspective view of the rotary portion of the rotary switch version of the present invention.

The pivot shaft or stud 58 is, of course, centrally formed on retainer plate 68 as shown clearly in FIG. 10.

When the rotor 59 has been assembled as described above with its contact disc 65, leaf spring 63 and retainer plate 68 in place, such rotary assembly is installed in housing 50 (with its already installed terminals 34).

Figure 8:
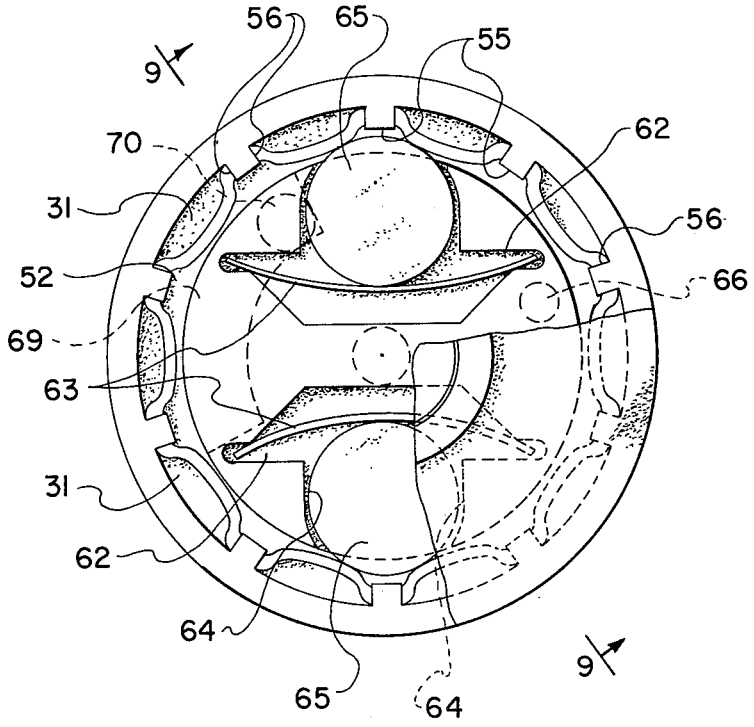
FIG. 8 is a cutaway top plan view of the switch shown in FIG. 7.

As can be seen in FIG. 8, the discs 65 are so sized to contact adjacent terminals 34 thus such discs, because of the biasing of springs 63, act as a detent with the spring being flexed as the rotor 59 is turned and the discs 65 move from between one pair of adjacent terminals to the next.

Circular cover plate 71 is next slipped over shaft 61 and into contactive engagement with shoulder 72. Through ultrasonic welding procedures, the upper edge 73 of housing 50 is curled over the periphery 74 of cover plate 71 as shown in dotted lines at 75 in FIG. 9 to permanently secure the cover plate 71 to housing 50.

A threaded portion 76 is provided on the upper exterior portion surrounding actuator shaft 69 so that the rotary shaft can be thru mounted and retained by a locking nut (not shown). Also a position locking stud 77 is provided to prevent unintentional rotation of this version of the switch when it is thru mounted. Locking means of this type are, of course, well known to those skilled in the art and further description of the same is not deemed necessary.

The rotary version of the present invention can, of course, also be board mounted as hereinabove described for the slide version with the mounting support 20 being in contactive engagement with the upper surface of such board and the prongs 39 of each of the terminals 34 passing therethrough for appropriate circuit connection.

From the above, it can be seen that the present invention has the advantage of providing a molded switch of rugged construction which is simple to assemble, is permanently sealed against inadvertent separation, and is long-lasting in operation. The present invention also has the advantage of providing a molded switch wherein the terminals act as switch contact points and which are retained within a housing by the cover plate installed thereon. The present invention has the additional advantage of providing a relatively inexpensive and yet highly efficient switch means with a superior electrical rating and which reduces to a minimum the chance of internal arcing.

The terms "sides", "bottom", "top" and so forth have been used herein merely for convenience in the foregoing specification and in the appended Claims to describe the switch and its parts as oriented in the drawings. It is to be understood, however, that these terms are in no way limiting to the invention since the switch may obviously be disposed in many different positions when in use.

The present invention may, of course, be carried out in other specific ways than those herein set forth without departing from the spirit and essential characteristics of the invention. The present embodiments are, therefore, to be considered in all respects as illustrative and not restrictive and all changes coming within the meaning and equivalency range of the appended claims are intended to be embraced therein.

What is claimed is:

1. An electrical type switching means comprising: a switch housing having side wall means and a bottom means; a plurality of slot-like openings provided in the interior portion of said side wall means, the interior edge of each said slots being more constricted in cross section than the remainder of said slot; openings in said bottom means a parallel alignment with each of said slot means; electrically conductive terminal means slidingly mounted into and retained by said slot means and projecting outwardly through said openings in said bottom, the slot engaging portion of each of said terminal means being generally arcuate in cross section and convexingly disposed relative to the interior side wall means of said housing; actuator motivated, electrically conductive contact means for making and breaking contact between said terminals; and a cover means for enclosing said housing and retaining said terminals within said slots whereby an improved electrical switch means is provided.

2. The switch means of claim 1 wherein the cover means is ultrasonically welded to said housing means.

3. The switch means of claim 2 wherein a raised flash guard is provided on said housing juxtaposed to said cover to prevent undesirable weldment material entering said housing during the ultrasonic welding process.

4. The switch means of claim 1 wherein mounting supports are provided on the exterior of said bottom means whereby more stable switch mounting can be accomplished.

5. The switch means of claim 4 wherein said mounting supports are disposed exterior of said terminal means to protect the same from damage.

6. The switch means of claim 1 wherein the terminal receiving openings in said bottom means are slightly smaller than the portion of said terminals projecting therethrough whereby a snug fit can be accomplished.

7. The switch means of claim 1 wherein the contact means is slidingly mounted.

8. The switch means of claim 7 wherein the slidingly mounted contact means includes at least one spring biased, electrically conductive means.

9. The swtich means of claim 7 wherein the slidingly mounted contact means includes a non-conductive partition slidely mounted within a longitudinal groove in the interior side of said bottom means whereby internal electrical arcing is reduced.

10. The switch means of claim 1 wherein the contact means is rotatively mounted.

11. The switch means of claim 10 wherein said rotatively mounted contact includes at least one spring biased, electrically conductive contact means.

12. The switch means of claim 11 wherein said rotatively mounted contact means is a disc shaped member.

* * * * *